US006224236B1

(12) United States Patent
Shu

(10) Patent No.: US 6,224,236 B1
(45) Date of Patent: May 1, 2001

(54) LIGHT-EMITTING AMUSEMENT RETRACTABLE SEAT

(76) Inventor: Ming-Tay Shu, P.O. Box 82-144, Taipei (TW)

( * ) Notice: Subject to any disclaimer, the term of this patent is extended or adjusted under 35 U.S.C. 154(b) by 0 days.

(21) Appl. No.: 09/408,573

(22) Filed: Sep. 28, 1999

(51) Int. Cl.[7] ..... F21L 11/00
(52) U.S. Cl. ..... 362/205; 362/109; 362/202
(58) Field of Search ..... 362/109, 202, 362/205, 208, 253

(56) References Cited

U.S. PATENT DOCUMENTS 4,504,890 * 3/1985 Chan ..... 362/205
4,888,667 * 12/1989 Hwang ..... 362/119
5,735,594 * 4/1998 Own ..... 362/205
6,024,467 * 2/2000 Liu ..... 362/205

* cited by examiner

*Primary Examiner*—Thomas M. Sember
*Assistant Examiner*—Peggy A Neils
(74) *Attorney, Agent, or Firm*—A & J

(57) ABSTRACT

A light-emitting amusement retractable seat comprising a top cover, a combined body including a light-emitting seat, a light-emitting cover, and a light-emitting diode, a sleeve mounted below the top cover, a clipping seat mounted within the sleeve, a spring and a metallic cap mounted in between the light-emitting seat and the clipping seat, a rotating seat mounted within the clipping seat, a retractable socket mounted within the rotating seat, and a combination of usable objects mounted within the retractable socket, and a bottom cover mounted at the bottom of the sleeve to protect the combination of usable objects such as an eraser, a lipstick, a lipstick get or a stamp having elongated shapes. The inner wall of the sleeve is provided with two vertical protruded rails, corresponding to each other to guide the entry of the vertical guiding grooves at the outer wall of the clipping seat. The vertical guiding grooves provide entrance for two protruded pegs mounted at the left and right side of the retractable socket. A depressed ring is provided at the bottom portion of the inner wall of the clipping seat for the mounting of a protruded ring mounted to the outer wall of the rotating seat. The rotating seat is provided with two loop grooves for the entrance of the protruded pegs of the retractable socket. When the rotating seat rotates, the elongated usable object retracts and when the retractable seat is pressed, the light-emitting diode of the light-emitting seat produces light which is an amusement to the user.

3 Claims, 9 Drawing Sheets

LIGHT-EMITTING AMUSEMENT RETRACTABLE SEAT

BACKGROUND OF THE INVENTION a) Technical Field of the Invention

The present invention relates to a light-emitting amusement retractable seat, and in particular, to a retractable seat containing an eraser, lipstick, lipstick gel, stamp, etc. and used as toys or stationery or cosmetics for the children.

b) Description of the Prior Art

Among toys, stationery and cosmetics for children, there are retractable erasers, lipsticks, lipstick gel and amusement stamp available in the market. However, these products provide only a single function, which are less interesting to the children.

SUMMARY OF THE INVENTION

Accordingly, it is an object of the present invention to provide a light-emitting amusement retractable seat comprising a top cover, a combined body including a light-emitting seat, a light-emitting cover, and a light-emitting diode, a sleeve mounted below the top cover, a clipping seat mounted within the sleeve, a spring and a metallic cap mounted in between the light-emitting seat and the clipping seat, a rotating seat mounted within the clipping seat, a retractable socket mounted within the rotating seat, and a combination of usable objects mounted within the retractable socket, and a bottom cover mounted at the bottom of the sleeve to protect the combination of usable objects such as an eraser, a lipstick, a lipstick gel, or a stamp having elongated shapes.

Another object of the present invention is to provide a light-emitting amusement retractable seat, wherein the clipping seat does not dislocate from the sleeve after the two guiding grooves of the clipping seat are associated with the vertical protruded rails at the outer wall of the sleeve.

Yet another object of the present invention is to provide a light-emitting amusement retractable seat, wherein the two protruded pegs of the retractable socket are guided into the loop grooves of the rotating seat, and the rotating seat provides rotational movement and urges the retractable socket to produce a radial movement.

It is yet another object of the present invention to provide a light-emitting amusement retractable seat, wherein when the clipping seat raises, the metallic cap at the top of the clipping seat contacts with the batteries within the light-emitting seat and also in contact with the spring, the spring conducts electrical current to the light-emitting diode such that the light-emitting diode is lighted.

Another object of the present invention is to provide a light-emitting amusement retractable seat, wherein the spring is provided in between the clipping seat and the light-emitting seat, and the spring causes the clipping seat to be retractable.

Yet another object of the present invention is to provide a light-emitting amusement retractable seat, wherein the retractable seat has a small size and can be carried in the pocket of the children, and it can be used conveniently.

It is another object of the present invention to provide a light-emitting amusement retractable seat, wherein the inner wall of the sleeve is provided with two vertical protruded rails, corresponding to each other, to guide the entry of two vertical guiding grooves at the outer wall of the clipping seat. Two vertical guiding grooves formed at the inner wall of the clipping seat provide entrance for two protruded pegs mounted at the left and right side of the retractable sleeve. A depressed ring is provided at the bottom portion of the inner wall of the clipping seat for the mounting of a protruded ring mounted to the outer wall of the rotating seat. The rotating seat is provided with two loop grooves for the entrance of the protruded pegs of the retractable sleeve.

Another object of the present invention is to provide a light-emitting amusement retractable seat, where, the top of the clipping seat is mounted with a metallic cap urging the spring at one end. The other end of the spring is connected in series to the bottom of the light-emitting seat and in contact with one of the contacting leg of the light-emitting diode, and the other contacting leg of the light-emitting diode is in contact with the battery terminal within the light-emitting seat.

Yet another object of the present invention is to provide a light-emitting amusement retractable seat, wherein when the retractable seat is pressed onto a paper, the light-emitting diode produces flickering amusement light.

BRIEF DESCRIPTION OF THE DRAWINGS

In order that the invention may be more clearly understood, it will now be disclosed in greater detail with reference to the accompanying drawings, wherein.

DETAILED DESCRIPTION OF THE PRESENT INVENTION

Figure 1:
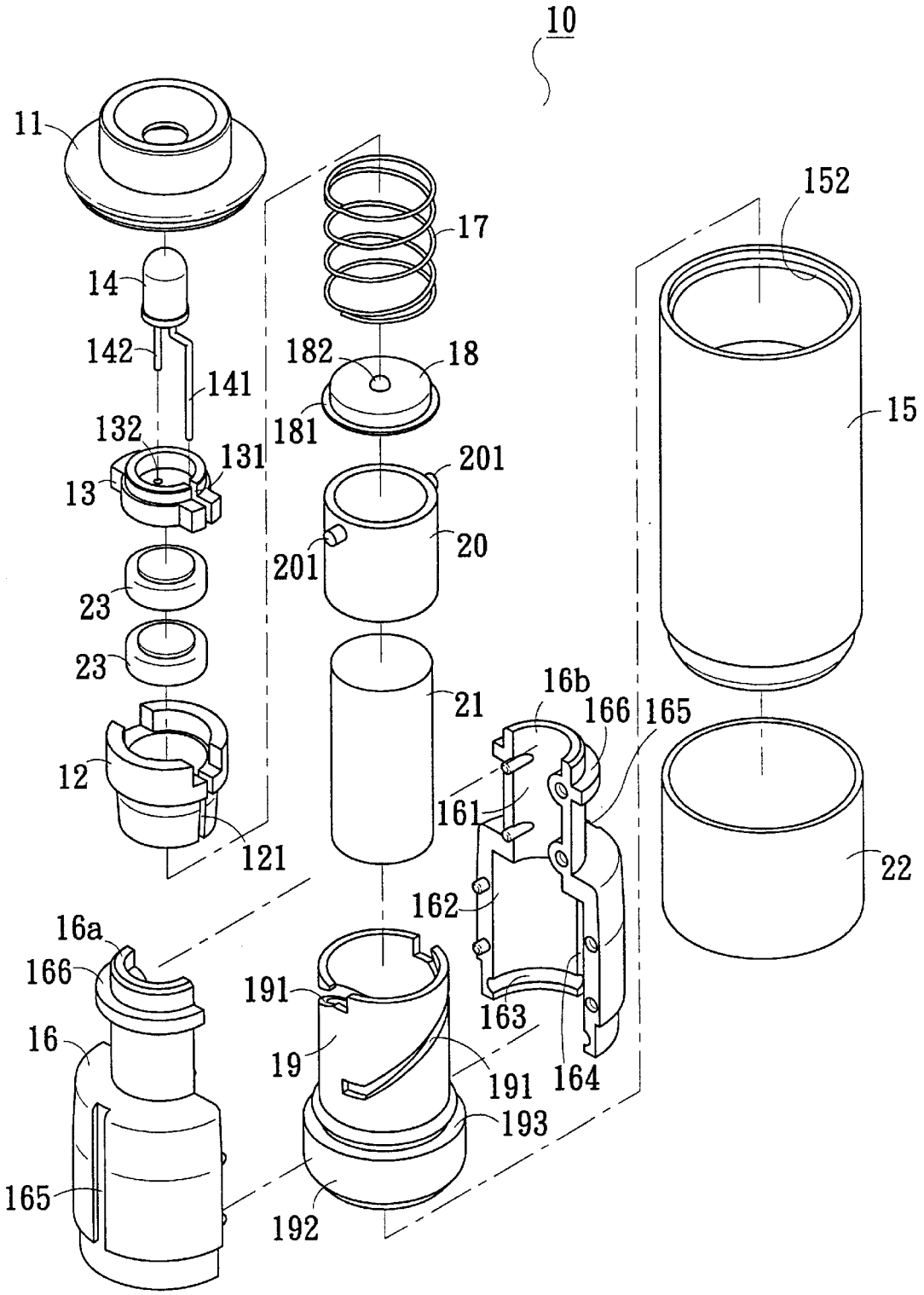
FIG. 1 is a perspective exploded view of the light-emitting amusement retractable seat in accordance with the present invention.
Figure 2:
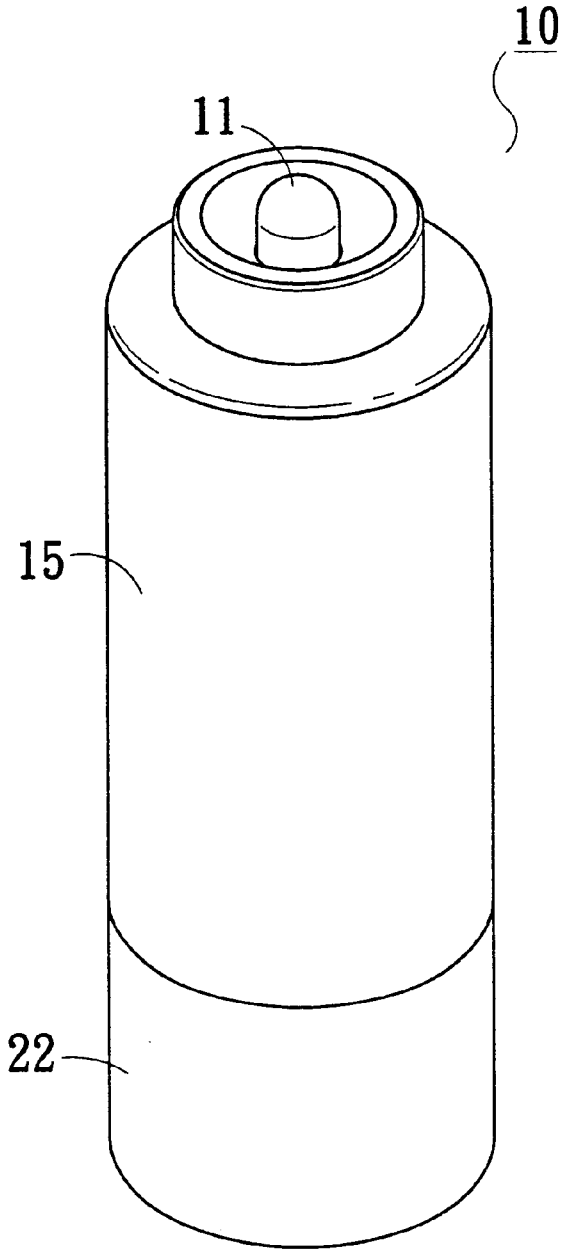
FIG. 2 is a perspective view of the light-emitting amusement retractable seat in accordance with the present invention.

Referring to FIGS. 1 and 2, there is shown the retractable seat 10 in accordance with the present invention. As shown in the figures, the light-emitting amusement retractable seat 10 comprises a top cover 11, a combined body including a light-emitting seat 12, a light-emitting cover 13, and a light-emitting diode 14, a sleeve 15 mounted below the top cover 11, a clipping seat 16 mounted within the sleeve 15, a spring 17 and a metallic cap 18 mounted in between the light-emitting seat 12 and the clipping seat 16, a rotating seat 19 mounted within the clipping seat 16, a retractable socket 20 mounted within the rotating seat 19, and a combination of usable objects 21 mounted within the retractable socket 20, and a protection cover 22 mounted at the bottom of the sleeve 15 to protect the elongated objects 21.

Figure 3:
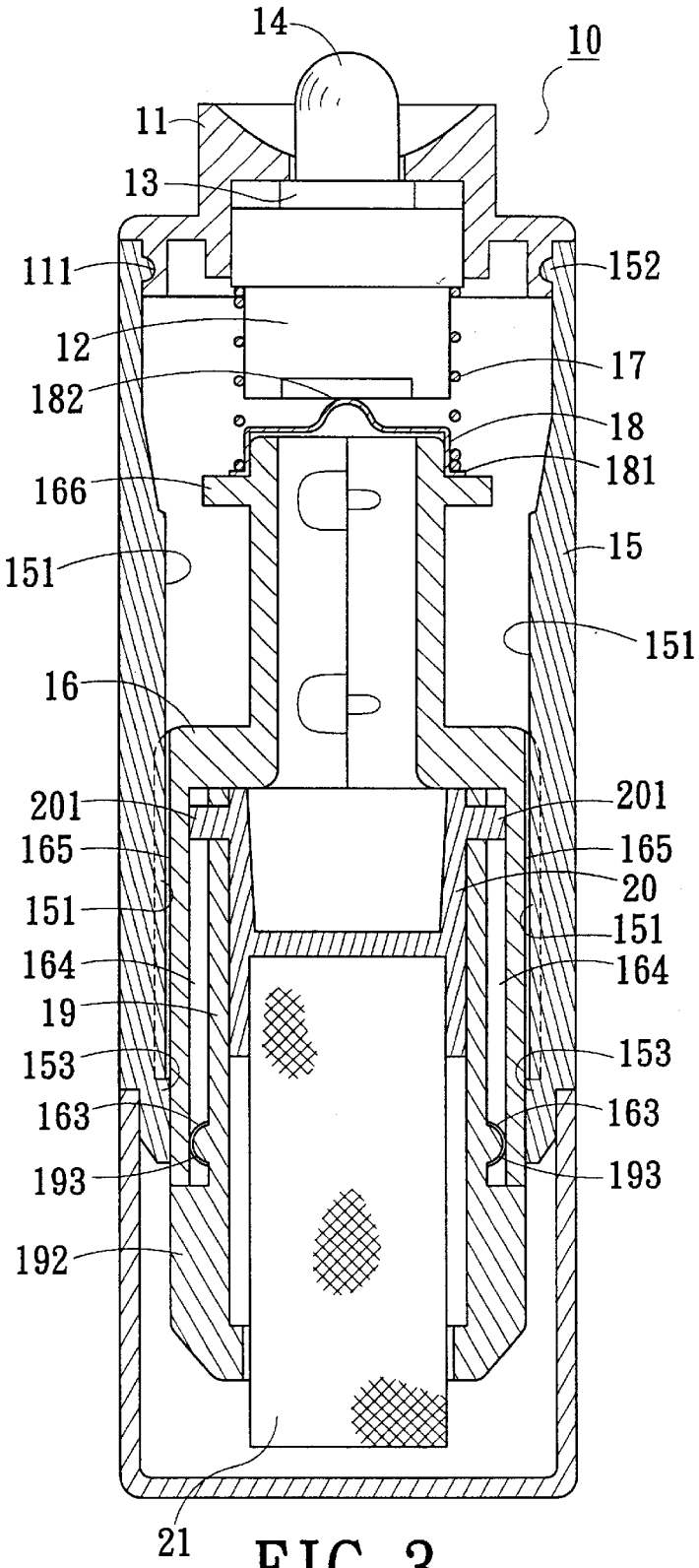
FIG. 3 is a sectional view of light-emitting amusement retractable seat in accordance with the present invention.
Figure 4:
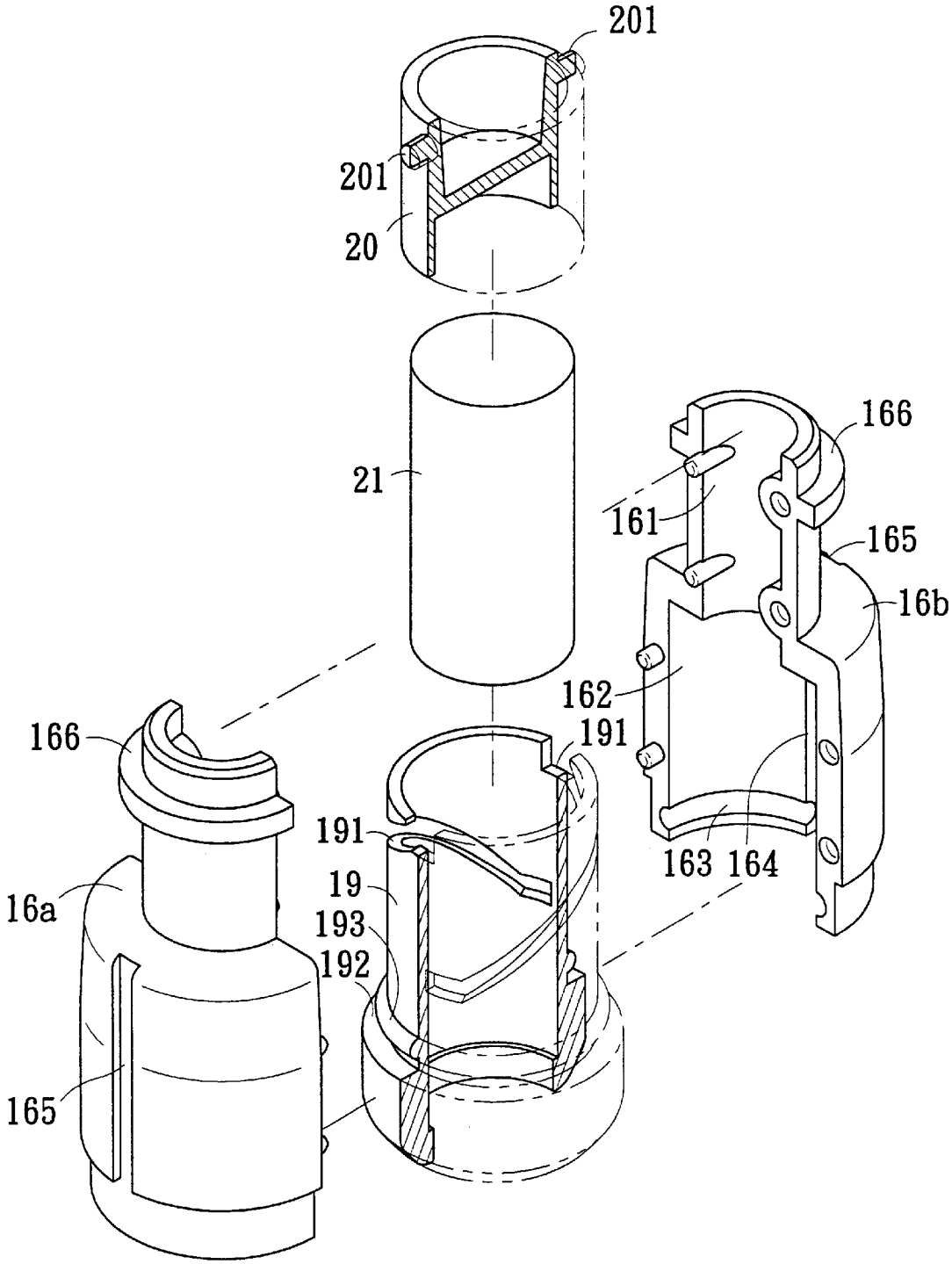
FIG. 4 is a perspective exploded view of the clipping seat, the rotating seat, and the retractable socket in accordance with the present invention.

Referring to FIGS. 3 and 4, the clipping seat 16 comprises two half-molded body 16*a* and 16*b* combined together and the interior of the clipping seat 16 is hollow. The top and middle section of the clipping seat 16 is a hollow neck 161 having a smaller diameter and the bottom section is a hollow slot 162 having a larger diameter. At the bottom end of the hollow slot 162, a depressed ring 163 is provided, and the side wall thereof is provided with two symmetrical vertical guiding grooves 164. At the outer wall of the clipping seat 16, two vertical guiding grooves 165 are provided. The rotating seat 19 can be inserted into the hollow slot 162 of the clipping seat 162 and the rotating seat 19 is a hollow body having two loop grooves 191 at the top end thereof, circulating from the top to the bottom. At the bottom end of the outer wall of the rotating seat 19, a blocking ring 192 having a relative larger diameter is provided and can contact with the bottom edge of the clipping seat 16 (as disclosed in FIG. 3). A protruded ring 193 is provided at the blocking ring 192 to mount with the depressed ring 163 of the clipping seat 16 such that the rotating seat 19 can rotate in 360 degree but will not disengage from the clipping seat 16. Further, the retractable socket 20 can contain the elongated objects 21 (an eraser, lipstick, lipstick gel, color pencil, stamp, etc) and the combined objects 21 are placed into the rotating seat 19. The outer wall of the retractable socket 20 is provided with two symmetrical protruded pegs 201 which can pass through the loop grooves 191 of the rotating seat 19 and are guided into the vertical guiding grooves 164 of the clipping seat 16.

Figure 5:
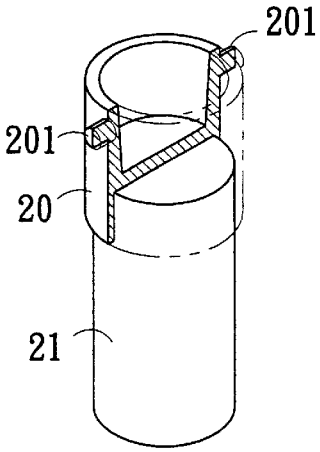
FIG. 5 is a schematic view of the combination of the retractable sleeve and the elongated-shaped object in accordance with the present invention.
Figure 6:
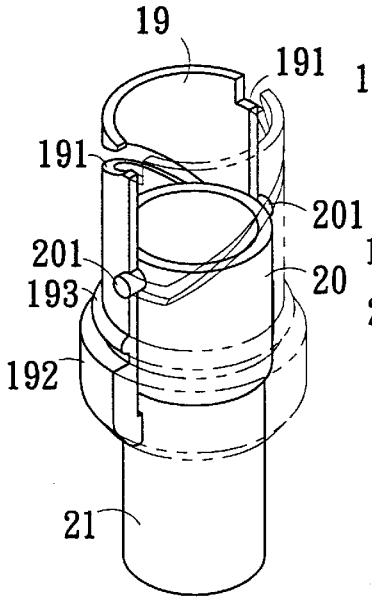
FIG. 6 is a schematic view of the combination of the retractable socket and the rotating seat of FIG. 5.
Figure 7:
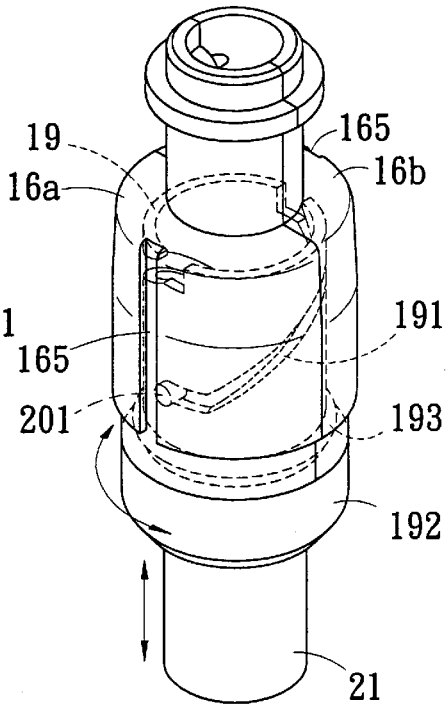
FIG. 7 is a schematic view of the combination of the rotating seat and the clipping seat of FIG. 6.

FIGS. 5–7 shows the combination of the clipping seat 16, the rotating seat 19, and the retractable socket 20. First, the elongated usable object 21 is inserted into the retractable socket 20 (as shown in FIG. 5), and then, the two protruded pegs 201 of the retractable socket 20 is inserted from the top end entrance of the loop grooves 191 of the rotating seat 19 (as shown in FIG. 6). Finally, the two semi-molded body 16*a*, 16*b* of the clipping seat 16 are combined together to contain the rotating seat 19 (as shown in FIG. 7), and the two protruded pegs 201 of the retractable socket 20 are inserted into the vertical guiding grooves 164. Thus, the rotation of the rotating seat 19 urges the retractable socket 20 to produce a radial retraction movement. When the elongated usable object 21 has been used up or is needed to be extended in length, the rotating seat 19 is rotated and the elongated usable object 21 will be extended out. The reverse direction of rotation of the rotating seat 19 will shorten the elongated usable object 21.

Figure 8:
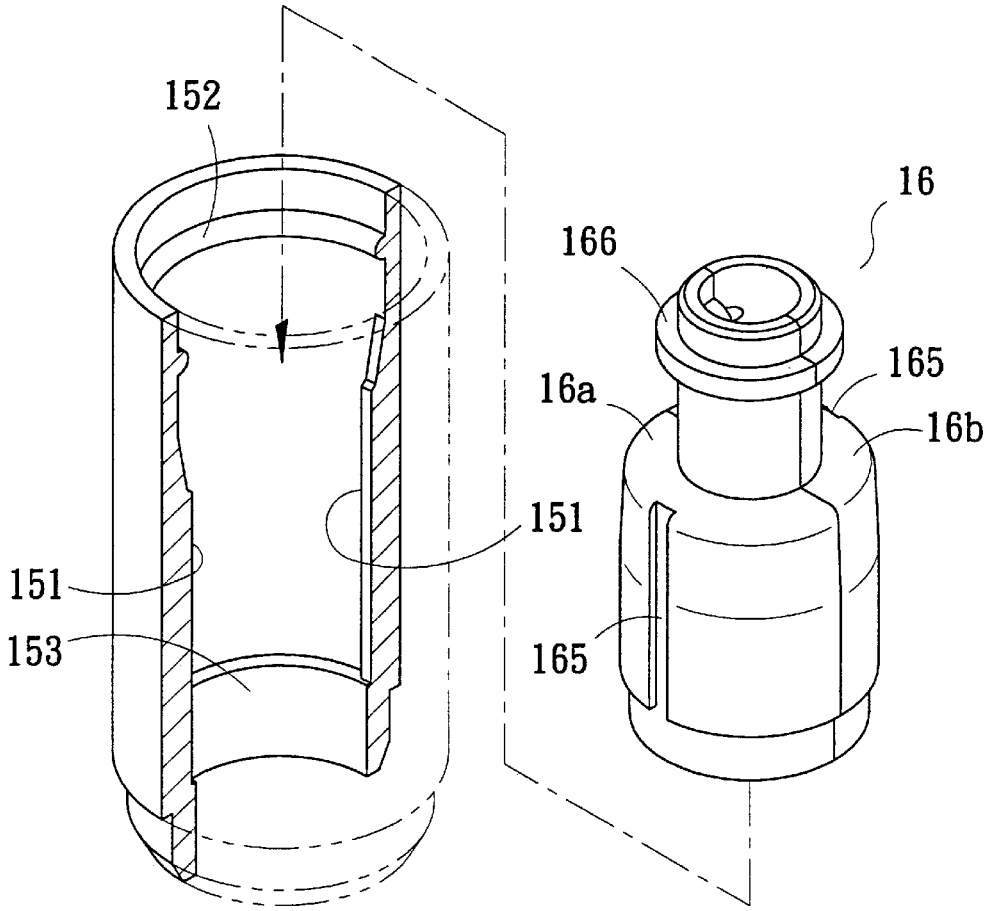
FIGS. 8 is a schematic view of the combination of the clipping seat and the sleeve of FIG. 7.

Referring to FIG. 8, after the above-mentioned combined structure has been completed, it is then inserted into the sleeve 15 having two corresponding vertical protruded rails 151 at the inner wall of the sleeve 15, which can be guided onto the two vertical guiding grooves 165 at the outer wall of the clipping seat 16 such that the clipping seat 16 can radially move up or down within the sleeve 15 but cannot be rotated. In addition, the top end of the inner wall of the sleeve 15 is provided with a protruded ring 152 which is engageable with the depressed ring 111 at the outer wall of the top cover 11 (referring to FIG. 3) such that the top cover 11 is mounted at the top end of the sleeve 15. Additionally, the bottom end of the inner wall of the sleeve 15 is provided with the blocking ring 153 having a relative smaller diameter and is used to block the clipping seat 16 (referring to FIG. 3) from falling downward.

In addition, FIG. 3 also discloses the top end of the clipping seat 16 being mounted with the metallic cap 18 having a bottom ring 181 and being supported at the protruded ring 166 at the top end of the clipping seat 16. The spring 17 is connected in series in between the bottom ring 181 and the light-emitting seat 12. The clipping seat 16 is lowered as a result of the expansion of the spring 17 and a protrusion 182 of the top surface of the metallic cap 18 does not contact with the battery within the light-emitting seat 12.

Figure 9:
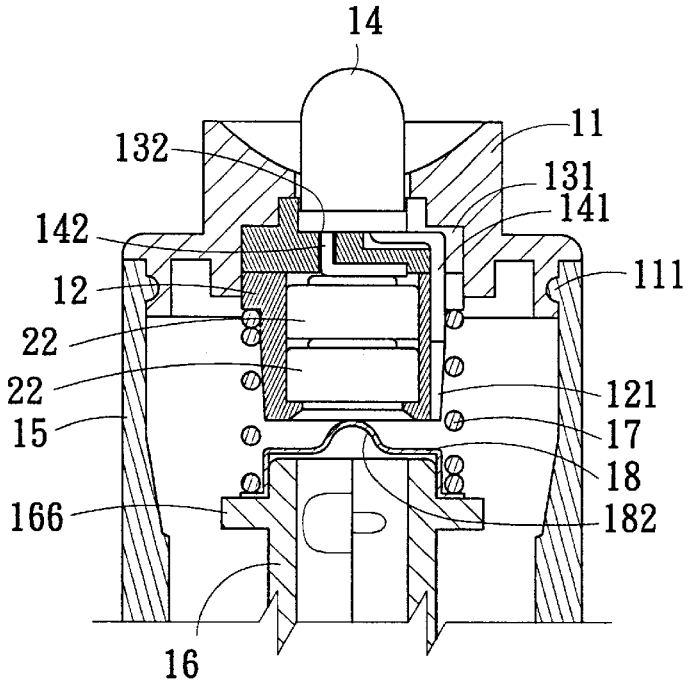
FIG. 9 is a sectional view of the combination of the light-emitting seat, the light emitting cover, the light-emitting diode, of the present invention, the light emitting diode being at the OFF state.
Figure 10:
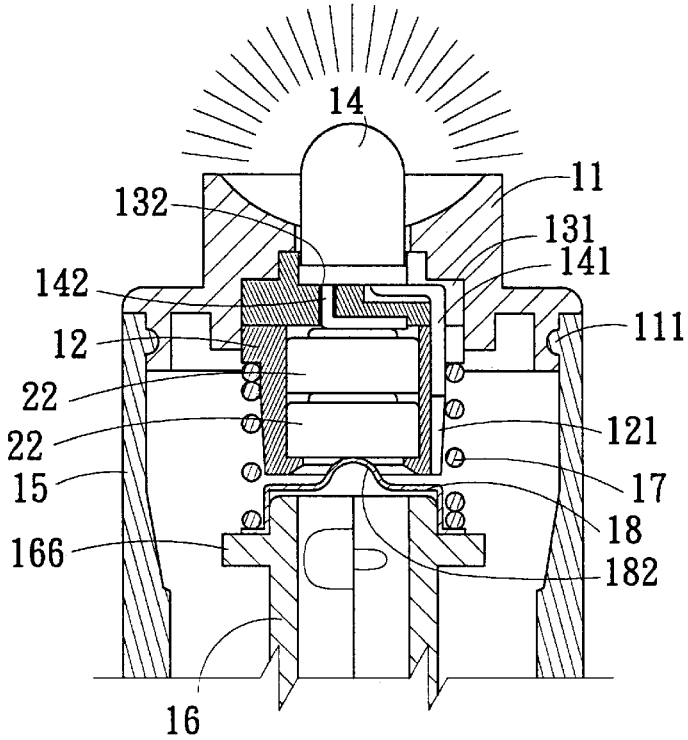
FIG. 10 shows the light-emitting diode at the state of light emitting.

As shown in FIGS. 9 and 10, the light-emitting seat 12 is a hollow seat body containing two batteries 23 connected in series. The top end of the seat 12 is combined with the light-emitting cover 13. The side end of the light-emitting cover 13 and the light-emitting seat 12 are provided with vertical slots 121, 131 to contain the long contacting leg 141 of the light-emitting diode 14. The long contacting leg 141 is in contact with the spring 17, and the other short leg 142 of the light emitting diode 14 passes through a small hole 132 at the light-emitting cover 13 and is formed into an L shape structure, and contacts with the terminal of the batteries 23. The metallic cap 18 at the clipping seat 16 urges by the spring 17 causing the protrusion 182 from not touching the terminal of the batteries 23 (as shown in FIG. 9). When the clipping seat 16 moves upward, the protrusion 182 of the metallic cap 18 is in contact with the batteries 23 and the light-emitting diode 14 is thus lighted (as shown in FIG. 10).

Figure 11:
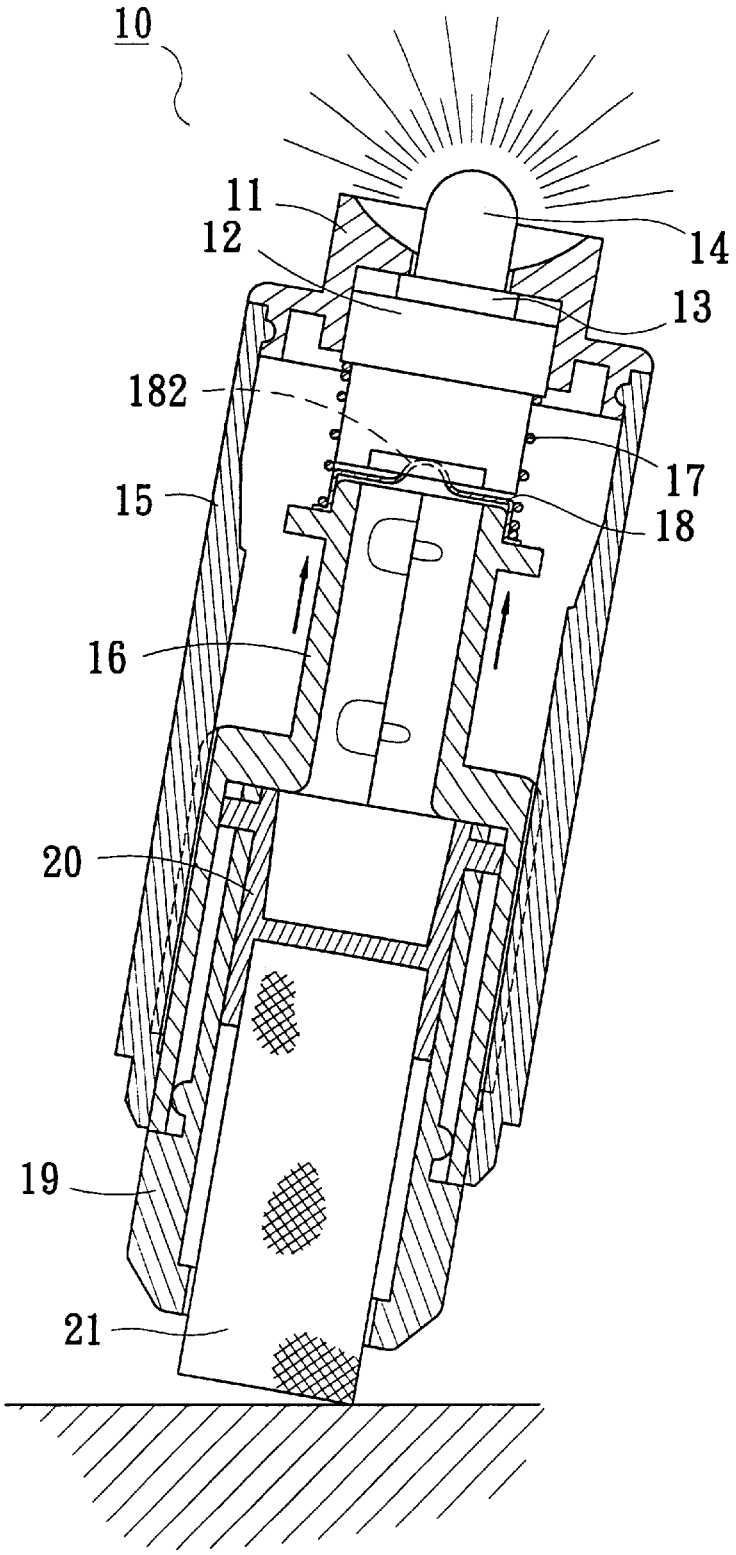
FIG. 11 is a schematic view showing the implementation of the light-emitting amusement retractable seat in accordance with the present invention.
Figure 12:
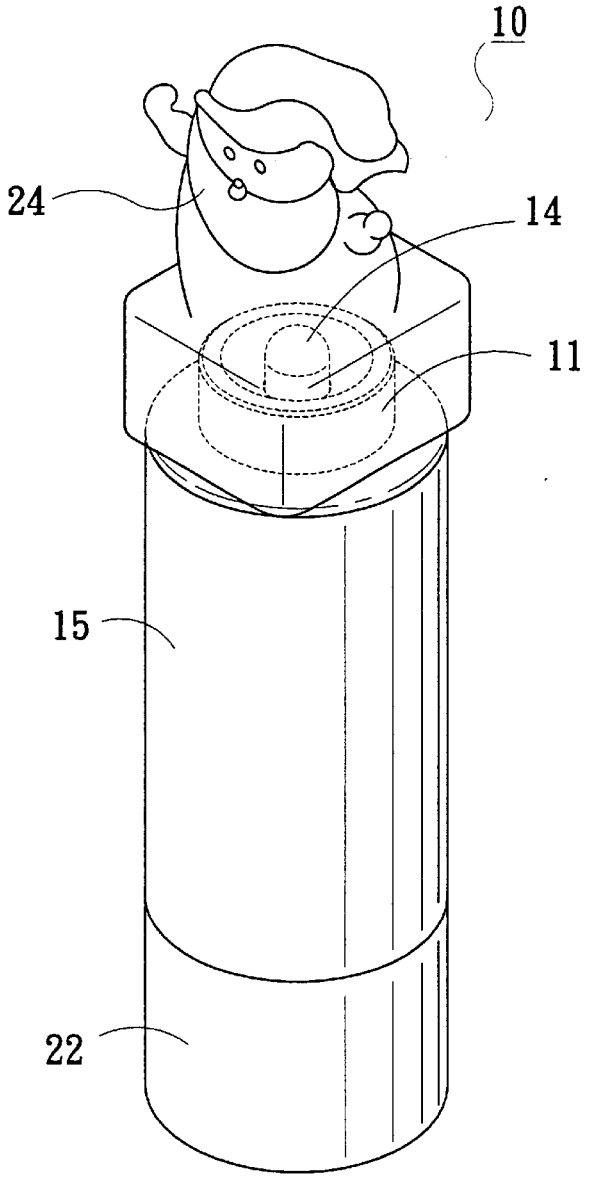
FIG. 12 is a perspective view of the light-emitting amusement retractable seat mounted with a transparent ornamental design thereto in accordance with the present invention.

FIG. 11 is a schematic view showing the implementation of the present invention. As shown in FIG. 10, the protection cover 22 at the bottom of the retractable seat 10 is first unloaded, and the bottom end of the elongated usable object 21 is used to press onto a flat surface. At this instance, the clipping seat 16 moves upward radially and the protrusion 182 of the metallic cap 18 contacts with the terminal of the batteries 23 and the light-emitting diode 14 is lighted and a flickering effect of amusement light is obtained. If no pressure is applied to the usable object (eraser 21), the spring 17 causes the clipping seat 16 to restore to its original shape. Thus, in view of the light-emitting diode 14, it indicates whether the usable object 21 has been pressed onto a paper. In addition, a transparent ornamental design 24 of various shapes may be mounted onto the sleeve 15 (as shown in FIG. 12). Reflection of light is obtained when light passes through the ornamental design 24.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A light-emitting amusement retractable seat comprising a top cover, a combined body including a light-emitting seat, a light-emitting cover, and a light-emitting diode, a sleeve mounted below the top cover, a clipping seat mounted within the sleeve, a spring and a metallic cap mounted in between the light-emitting seat and the clipping seat, a rotating seat mounted within the clipping seat, a retractable socket mounted within the rotating seat, and a combination of usable objects mounted within the retractable socket, characterized in that the clipping seat is hollow and has a hollow slot of larger diameter at the bottom section thereof and having a hollow neck of relative small diameter at the top and middle section thereof, a depressed ring is provided at the bottom end of the hollow slot, and the sidewall thereof is provided with two symmetrical vertical guiding grooves; and the outer wall of the clipping seat is provided with two vertical guiding grooves, the rotating seat being a hollow cylindrical shaped body can be inserted into the hollow slot of the clipping seat having two loop grooves at the top end, circulating towards the bottom end thereof, the lower end of the outer wall of the rotating seat is provided with a blocking ring of relative large diameter and in contact with the bottom edge of the clipping seat, a protruded ring is provided at the blocking ring and is adapted for the depressed ring of the clipping seat such that the rotating seat can rotate 360 without disengaging from the clipping seat; the retractable socket contains elongated usable object, which are inserted into the rotating seat, the outer wall of the retractable socket is provided with two symmetrical protruded pegs which can pass through the loop grooves of the rotating seat and enter the vertical guiding grooves of the clipping seat; the inner wall of the sleeve is provided with two symmetrical vertical protruded rails which can be inserted into the two vertical guiding grooves at the outer wall of the clipping seat such that the clipping seat, within the sleeve, can move radially up and down but cannot be rotated, the top end of the inner wall of the sleeve is provided with a protruded ring which can be mounted into the depressed ring at the outer wall of the top cover such that the top cover is fixed onto the top end of the sleeve, and the lower end of the inner wall of the sleeve is provided with a blocking ring having a smaller diameter to block the clipping seat from falling down; thereby if the elongated usable object is pressed, the clipping seat moves upward to cause the metallic cap to contact with the batteries within the light-emitting seat and the light-emitting diode is lighted.

2. A light-emitting amusement retractable seat as set forth in claim 1, wherein the light-emitting seat is a hollow seat body containing two batteries connected in series, the top end is combined with the light-emitting cover, and a vertical slot is provided at the lateral side of the light emitting cover and the light-emitting seat to contain the long contacting leg of the light-emitting diode, the long contacting leg is in contact with the spring and the short contacting leg of the light-emitting diode passes through the small hole at the light-emitting cover and is formed into an "L" shape, contacting the terminal end of the battery.

3. A light-emitting amusement retractable seat as set forth in claim 1, wherein the sleeve can be mounted with various type of transparent ornamental design, and the transparent ornamental design causes a light reflection to light.

* * * * *